US008905396B2

(12) United States Patent
Kuroda

(10) Patent No.: US 8,905,396 B2
(45) Date of Patent: Dec. 9, 2014

(54) IMAGE FORMING DEVICE

(71) Applicant: Murata Machinery, Ltd., Kyoto-shi, Kyoto (JP)

(72) Inventor: Yoshiharu Kuroda, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 14/051,235

(22) Filed: Oct. 10, 2013

(65) Prior Publication Data

US 2014/0117612 A1 May 1, 2014

(30) Foreign Application Priority Data

Nov. 1, 2012 (JP) ..... 2012-242111
Dec. 17, 2012 (JP) ..... 2012-274393

(51) Int. Cl.
*B65H 3/44* (2006.01)
*B65H 1/00* (2006.01)

(52) U.S. Cl.
CPC ... *B65H 3/44* (2013.01); *B65H 1/00* (2013.01)
USPC ..... 271/9.11; 271/9.06

(58) Field of Classification Search
CPC ..... B65H 3/446; B65H 2405/332; B65H 2405/3321; B65H 2405/3322; B65H 39/042; G03G 15/6508
USPC ..... 271/3.01, 9.06, 9.11; 399/391
See application file for complete search history.

(56) References Cited

U.S. PATENT DOCUMENTS 5,612,776 A * 3/1997 Machino et al. ..... 399/43
7,489,888 B2 * 2/2009 Sato et al. ..... 399/111

FOREIGN PATENT DOCUMENTS

| | | |
|---|---|---|
| JP | 04-174451 | 6/1992 |
| JP | 2004212767 A | 7/2004 |
| JP | 2006-091113 | 4/2006 |
| JP | 2006-279877 | 10/2006 |
| JP | 2010186108 A | 8/2010 |

* cited by examiner

*Primary Examiner* — Michael McCullough
(74) *Attorney, Agent, or Firm* — DLA Piper LLP (US)

(57) ABSTRACT

An image forming device includes an image recording unit for recording an image on a recording sheet, an upper paper feed cassette storage unit arranged above the image recording unit, a lower paper feed cassette storage unit arranged below the image recording unit, a lower paper feed cassette stored in the lower paper feed cassette storage unit, and an upper paper feed cassette stored in the upper paper feed cassette storage unit. The upper paper feed cassette has a larger lateral length than that of the lower paper feed cassette.

6 Claims, 7 Drawing Sheets

IMAGE FORMING DEVICE

CROSS-REFERENCE TO RELATED APPLICATIONS

This application claims priority under 35 U.S.C. 119 to Japanese Patent Application No. 2012-242111, filed on Nov. 1, 2012 and No. 2012-274393, filed on Dec. 17, 2012, which applications are hereby incorporated by reference in its entirety.

BACKGROUND OF THE INVENTION

1. Field of the Invention

The present invention relates to an image forming device such as a copier, a facsimile machine, a printer, or a multi-function peripheral having functions of the copier, the facsimile machine, and the printer, and in particular, to a technique of achieving a small footprint of the image forming device.

2. Description of the Related Art

An image forming device that is equipped with one paper feed cassette provided above an image recording unit and a paper exit tray provided below the image recording unit, and that is shaped like an inverted truncated square pyramid in outer appearance, has been known. Since the paper feed cassette is located above the image recording unit in this manner, the bottom area of the image forming device can be defined irrespective of size of recording sheets stored in the paper feed cassette, thereby achieving a small footprint of the image forming device.

However, in the above image forming device, since the paper feed cassette that stores stacked recording sheets is located in the upper side of the device, and the paper exit tray is located in the lower side of the device, it is inevitable that the gravity center of the entire device exists in the upper side, impairing the stability of the device. Further, this type of image forming device often includes a plurality of paper feed cassettes to form images on recording sheets of different sizes. In such a device, in the case where all of the paper feed cassettes are located above the image recording unit, it is inevitable that the device becomes more unstable.

BRIEF SUMMARY OF THE INVENTION

Therefore, an object of the present invention is to improve the stability of an installed image forming device provided with a plurality of paper feed cassettes while achieving a small footprint.

An image forming device according to the present invention includes an image recording unit for recording an image on recording sheets, an upper paper feed cassette storage unit arranged above the image recording unit, and a lower paper feed cassette storage unit arranged below the image recording unit. The device further includes an upper paper feed cassette stored in the upper paper feed cassette storage unit and a lower paper feed cassette stored in the lower paper feed cassette storage unit. A lateral length of the upper paper feed cassette is larger than that of the lower paper feed cassette.

In the image forming device according to the present invention, the upper paper feed cassette may be a large size cassette capable of storing a maximum size recording sheet on which the image recording unit can record an image, and the lower paper feed cassette may be a small size cassette that is smaller than the upper paper feed cassette.

In the image forming device according to the present invention, the maximum size of the recording sheet stored in the lower paper feed cassette is set to be equal to the maximum size of the recording sheet stored in the upper paper feed cassette. The recording sheet is stored in the upper paper feed cassette such that a long-side direction of the maximum size recording sheet is the lateral direction, and the recording sheet is stored in the lower paper feed cassette such that a short-side direction of the maximum size recording sheet is the lateral direction. A paper exit tray is formed below the upper paper feed cassette storage unit.

A first transportation path for transporting the recording sheet fed from the lower paper feed cassette to the paper exit tray via the image recording unit, and a second transportation path provided in parallel with the first transportation path for inverting the recording sheet transported via the image recording unit, are provided between the lower paper feed cassette storage unit and the paper exit tray. A third transportation path for transporting the recording sheet fed from the upper paper feed cassette to the second transportation path is provided between the upper paper feed cassette storage unit and the second transportation path. The recording sheet fed from the upper paper feed cassette is transported to the first transportation path through the third transportation path and the second transportation path.

In the image forming device according to the present invention, the lateral length of the upper paper feed cassette located above the image recording unit is larger than that of the lower paper feed cassette located below the image recording unit. Thus, the lateral width of the bottom of the image forming device, that is, the lateral width of the installed image forming device, can be made smaller than the lateral width of the upper paper feed cassette and the lateral width of the paper feed cassette storage unit that stores the paper feed cassette. Accordingly, the lateral width of the bottom area of the image forming device can be reduced, thereby achieving a small footprint.

Since the lower paper feed cassette is provided in addition to the upper paper feed cassette, recording sheets of different sizes can be stored in the respective cassettes, which can improve functionality and practicality of the image forming device. Moreover, since the lower paper feed cassette is arranged below the image recording unit, and the upper paper feed cassette is arranged above the image recording unit, the gravity center of the device can be prevented from being located too high, thereby improving the stability of the installed image forming device.

Specifically, the upper paper feed cassette arranged above the image recording unit may be a large size cassette capable of storing the maximum size recording sheet on which the image recording unit can record an image, and the lower paper feed cassette may be a small size cassette that is smaller than the upper paper feed cassette in the width direction (lateral direction). As a result, the bottom area, that is, the footprint of the image forming device, can be made unrelated to the size of the maximum size recording sheet on which the image recording unit can record an image, the size of the upper paper feed cassette, and the size of the upper paper feed cassette storage unit. Accordingly, this can reduce the bottom area of the image forming device, achieving a small footprint. That is, since the footprint of the image forming device can be made smaller than the outer frame of the upper paper feed cassette storage unit by making the width of the device lower side smaller than the device upper side, a small footprint of the image forming device can be achieved.

The maximum size of the recording sheet stored in the lower paper feed cassette is set to be equal to the maximum size of the recording sheet stored in the upper paper feed cassette. The recording sheet may be stored in the upper paper feed cassette such that the long-side direction of the maximum size recording sheet is the lateral direction, and the recording sheet may be stored in the lower paper feed cassette such that the short-side direction of the maximum size recording sheet is the lateral direction. Thus, since the lateral width of the lower paper feed cassette can be reduced, the lateral width of the bottom of the image forming device, that is, the lateral width of the installed image forming device, can be made smaller than the lateral width of the upper paper feed cassette and the lateral width of the upper paper feed cassette storage unit. Accordingly, the lateral width of the bottom area of the image forming device can be reduced and a small footprint achieved.

In the case where the paper exit tray is formed below the storage unit for the upper paper feed cassette, the recording sheet stored in the upper paper feed cassette is preliminarily heated by heat generated from the recording sheets discharged to the paper exit tray. This prevents poor recording quality on the recording sheet. Specifically, the recording sheet stored in the upper paper feed cassette can be preliminarily heated by heat generated from the recording sheets discharged to the paper exit tray, preventing poor recording quality on the recording sheet.

The recording sheet fed from the upper paper feed cassette can be transported to the first transportation path through the second transportation path for inverting the recording sheet transported via the image recording unit and the third transportation path for transporting the recording sheet fed from the upper paper feed cassette to the second transportation path. As a result, since it is necessary to add only the third transportation path to the conventional image forming device having a double side printing function, an increase of the number of parts due to provision of the upper paper feed cassette above the image recording unit is suppressed, contributing to low cost of the image forming device. That is, as compared to the case where a dedicated transportation path from the upper paper feed cassette to the image recording unit is provided, the number of components such as a feeding roller is made smaller, contributing to low cost of the image forming device.

Other features, elements, processes, steps, characteristics and advantages of the present invention will become more apparent from the following detailed description of embodiments of the present invention with reference to the attached drawings.

DETAILED DESCRIPTION OF EMBODIMENTS OF THE INVENTION

First Embodiment

Figure 1:
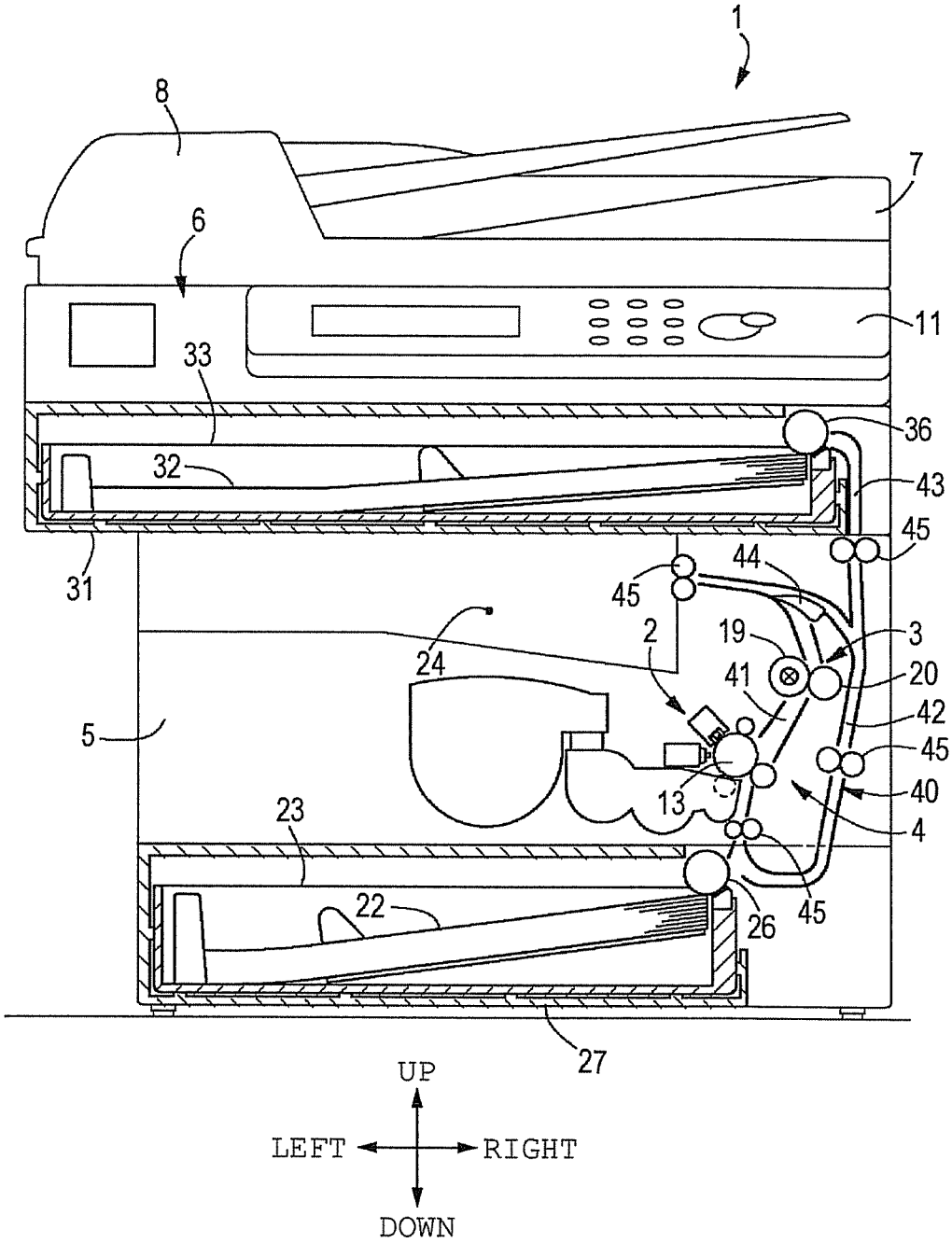
FIG. 1 is a schematic configuration view of an image forming device in accordance with a first embodiment of the present invention.
Figure 2:
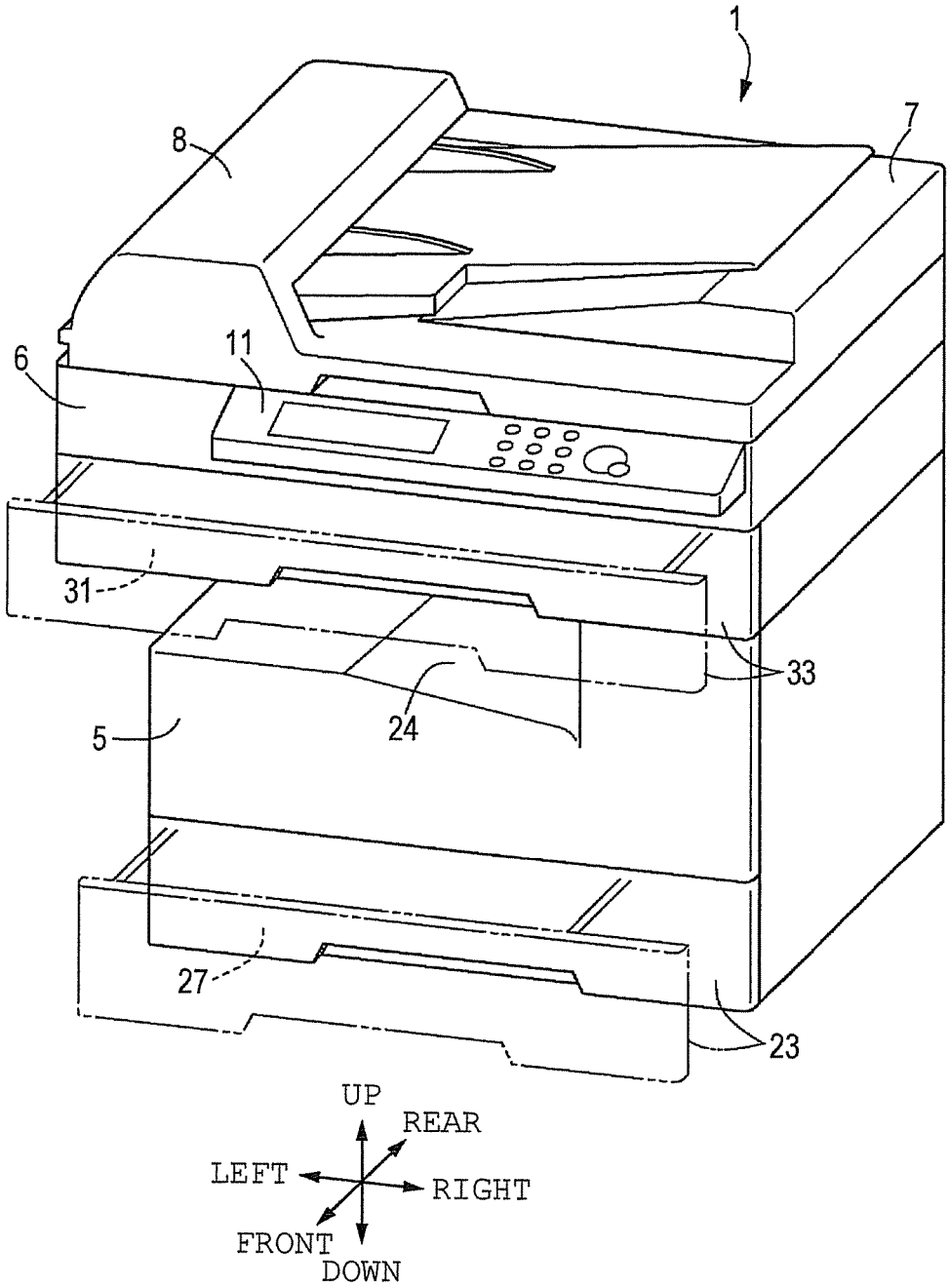
FIG. 2 is a schematic perspective view of the image forming device in accordance with the first embodiment of the present invention.
Figure 3:
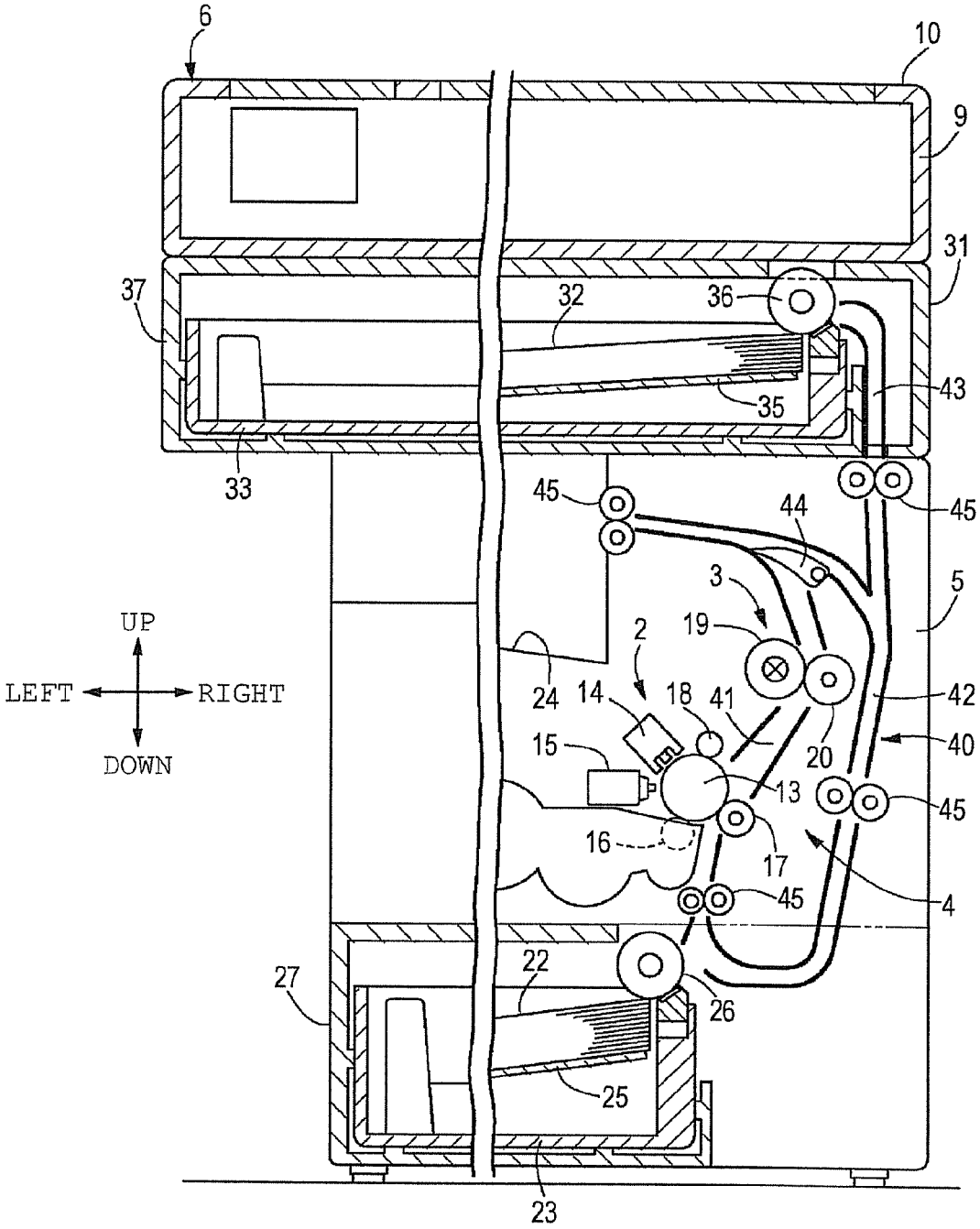
FIG. 3 is a schematic configuration view of a main part of the image forming device in accordance with the first embodiment of the present invention.

FIG. 1 to FIG. 3 illustrate a first embodiment in which an image forming device of the present invention is applied to a multi-function peripheral having a copying function and a faxing function. Front and rear, left and right, and up and down in this description follow arrows and indications of front and rear, left and right, and up and down near the arrows in FIG. 1 to FIG. 3.

In FIG. 1, a multi-function peripheral 1 is a desktop multi-function peripheral, which is used on a desk or the like, configured of a body 5 including an image recording unit 4 formed of an image forming unit 2 and a fusing unit 3, and an image reading unit 6 arranged above the body 5. A platen cover 7 for opening/closing a document reading surface and an automatic document reading unit 8 (ADF (Auto Document Feeder)) that is provided on the platen cover 7 and feeds a document to the image reading unit 6 are provided above the image reading unit 6. As illustrated in FIG. 3, the image reading unit 6 has a document tray 10 formed of a rectangular box-like frame 9 having a document glass on its upper surface, and a reading unit for reading the document, a carriage for supporting an optical system of the reading unit, and a CCD image sensor are arranged inside thereof. A control panel 11 equipped with various keys is provided on a front surface of the image reading unit 6 (Refer to FIG. 1).

As illustrated in FIG. 3, the image forming unit 2 is configured of a photoconductive drum 13, a charging device 14 arranged around the photoconductive drum 13, an exposure device 15, a development device 16, an image transfer roller 17, and a cleaning device 18 or the like. The fusing unit 3 is configured of a heater roller 19 and a press roller 20, and applies heat and pressure to a toner image formed on recording sheets 22 and 32 by the image forming unit 2 to fix the toner image on the recording sheets 22 and 32.

A lower paper feed cassette 23 on which the recording sheets 22 are stacked is arranged at the lowermost position in the body 5, the image forming unit 2 is arranged above the lower paper feed cassette 23, and the fusing unit 3 and a paper exit tray 24 are arranged above the image forming unit 2. The lower paper feed cassette 23 is shaped like a bottomed box opened to the upside, and includes a flapper 25 and a pickup roller 26 (Refer to FIG. 3). The lower paper feed cassette 23 can be pulled forward from a lower paper feed cassette storage unit 27 formed at the lower end of the body 5 (Refer to FIG. 2).

An upper paper feed cassette storage unit 31 is arranged between the body 5 and the image reading unit 6, and the upper paper feed cassette storage unit 31 stores the upper paper feed cassette 33 on which the recording sheets 32 are stacked. Like the lower paper feed cassette 23, the upper paper feed cassette 33 includes a flapper 35 and a pickup roller 36, and can be pulled forward from the upper paper feed cassette storage unit 31 (Refer to FIG. 2) The upper paper feed cassette storage unit 31 is formed using the rectangular box-like frame 37 as a base (Refer to FIG. 3).

A paper transportation path 40 for transporting the recording sheets 22 and 32 from the upper and lower paper feed cassettes 23 and 33 to the paper exit tray 24 is formed in the body 5 and the upper paper feed cassette storage unit 31. The paper transportation path 40 is configured of a first transportation path 41 for transporting the recording sheet 22 fed from the lower paper feed cassette 23 to the paper exit tray 24 via the image recording unit 4, a second transportation path 42 provided in parallel with the first transportation path 41 for inverting the recording sheet 22 transported via the image recording unit 4 at double side printing, and a third transportation path 43 for transporting the recording sheet 32 fed from the upper paper feed cassette 33 to the second transportation path 42. A guide 44 for controlling a transportation direction of the recording sheet 22 is provided at an upper branch point of the first transportation path 41 and the second transportation path 42. Reference numeral 45 denotes feeding rollers provided in the transportation paths 41, 42, and 43 for sending the recording sheets 22 and 32.

In the multi-function peripheral 1 in this embodiment, the upper paper feed cassette 33 arranged in the upper side of the device is a large size cassette capable of storing the maximum size recording sheet 32 on which the image recording unit 4 can record an image, and the lower paper feed cassette 23 is a cassette that is smaller than the upper paper feed cassette 33 in the lateral direction (width direction). Specifically, assuming that the maximum size recording sheet on which the multi-function peripheral 1 can record an image is an A3 size sheet, the upper paper feed cassette 33 is formed as a large size cassette capable of storing the A3 size recording sheet 32, and the lower paper feed cassette 23 is a small size cassette capable of storing an A4 size recording sheet 22, such that the upper paper feed cassette 33 is larger than the lower paper feed cassette 23 in outer frame.

In this case, the bottom area, that is, the footprint of the multi-function peripheral 1 can be made unrelated to the size of the maximum size recording sheet 32 on which the image recording unit 4 can record an image, the size of the upper paper feed cassette 33 storing the recording sheet 32, and the size of the upper paper feed cassette storage unit 31 storing the upper paper feed cassette 33. Accordingly, the bottom area of the multi-function peripheral 1 can be reduced, achieving a small footprint. That is, since the footprint of the multi-function peripheral 1 can be made smaller than the area of the outer frame of the upper paper feed cassette storage unit 31, a small footprint of the multi-function peripheral 1 can be achieved.

In the multi-function peripheral 1, since the lower paper feed cassette 23 is provided in addition to the upper paper feed cassette 33, the recording sheets 32 and 22 of different sizes can be stored in the cassettes 33 and 23, respectively, which can improve the functionality and the practicality of the multi-function peripheral 1. In addition, since the lower paper feed cassette 23 is arranged below the image recording unit 4 and the recording sheet 22 is stored in the lower paper feed cassette 23, the gravity center of the device can be prevented from being too high by arranging the upper paper feed cassette 33 above the image recording unit 4, thereby improving the stability of the installed desktop multi-function peripheral 1.

Since the paper exit tray 24 is formed below the upper paper feed cassette storage unit 31, the recording sheet 32 stored in the upper paper feed cassette 33 can be preliminarily heated by heat generated from the recording sheets 22 and 32 discharged to the paper exit tray 24. This can prevent poor recording quality on the recording sheet 32. That is, the heat generated from the recording sheets 22 and 32 discharged to the paper exit tray 24 removes excessive moisture in the sheet 32 in the upper paper feed cassette 33, preventing poor recording quality on the recording sheet 32 due to the moisture in the recording sheet 32 more reliably.

As described above, the multi-function peripheral 1 includes the second transportation path 42 for inverting the recording sheet 22 transported via the image recording unit 4, and the third transportation path 43 for transporting the recording sheet 32 fed from the upper paper feed cassette 33 to the second transportation path 42. Further, in the multi-function peripheral 1, the recording sheet 32 fed from the upper paper feed cassette 33 through the second and third transportation paths 42 and 43 is transported to the first transportation path 41, and the image recording unit 4 forms an image on the recording sheet 32. Since only the third transportation path 43 is added to the conventional multi-function peripheral having the double side printing function, low cost for the multi-function peripheral 1 can be achieved without an increase in the number of parts due to provision of the upper paper feed cassette 33 above the image recording unit 4. That is, as compared to the case where a dedicated transportation path from the upper paper feed cassette 33 to the image recording unit 4 is provided, the component such as the feeding roller 45 may be omitted, contributing to low cost of the multi-function peripheral 1.

As illustrated in FIG. 3, since the image reading unit 6 including the document tray 10 formed of the rectangular box-like frame 9, and the upper paper feed cassette storage unit 31 using the rectangular box-like frame 37 as a base are arranged in the upper side of the multi-function peripheral 1, the structural strength of the upper side of the multi-function peripheral 1 is reliably improved with simple configuration.

Figure 4:
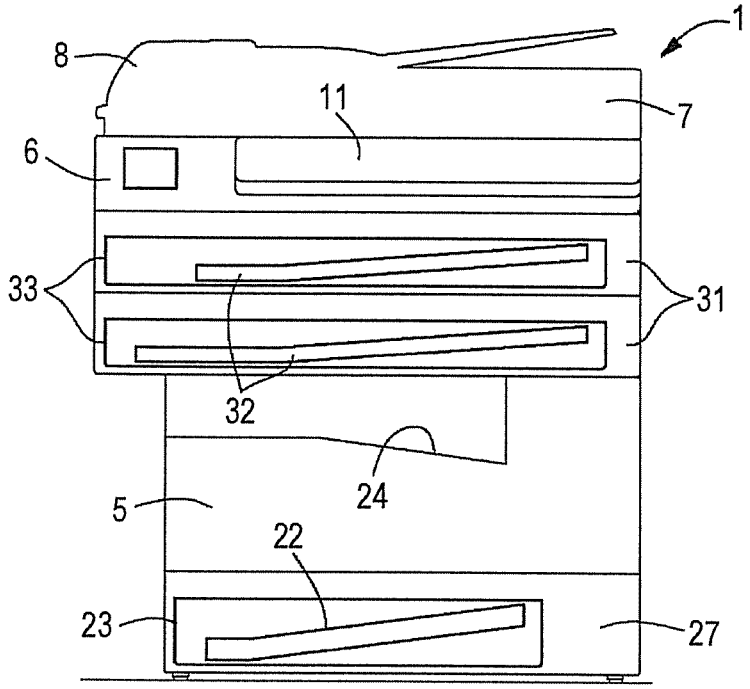
FIG. 4 is a schematic configuration view illustrating another embodiment of the image forming device in accordance with the first embodiment of the present invention.
Figure 5:
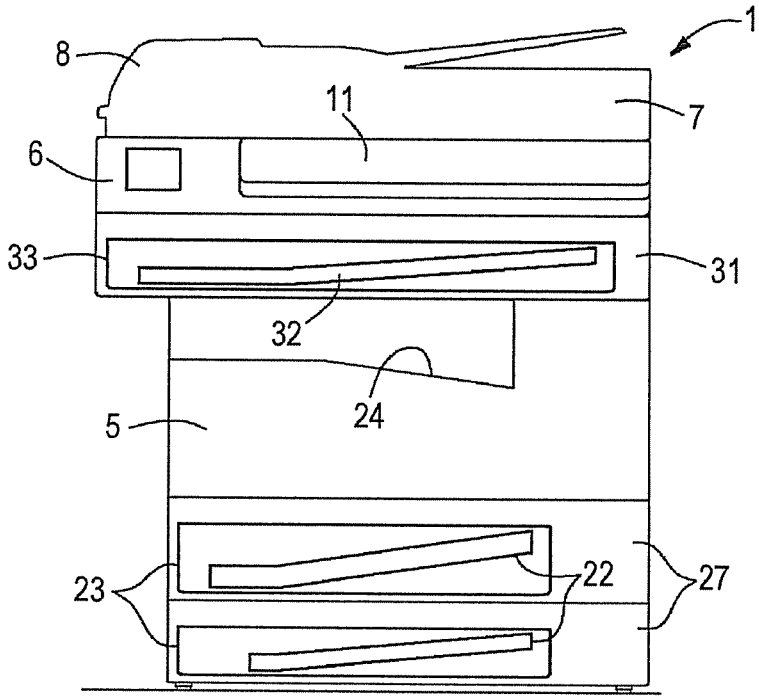
FIG. 5 is a schematic configuration view illustrating another embodiment of the image forming device in accordance with the first embodiment of the present invention.

FIG. 4 and FIG. 5 illustrate another embodiment of the present invention. In an image forming device (multi-function peripheral) 1 illustrated in FIG. 4, two upper paper feed cassette storage units 31 and 31 are provided between the body 5 and the image reading unit 6. In an image forming device (multi-function peripheral) 1 illustrated in FIG. 5, two lower paper feed cassette storage units 27 and 27 are provided at the lower end of the body 5. As described above, the number of upper paper feed cassette storage units 31 and the number of the lower paper feed cassette storage units 27 are not limited to one, and may be two or more. In summary, the upper paper feed cassette 33 only needs to have enough size to store the maximum size recording sheet 32 on which the image recording unit 4 can record an image.

Second Embodiment

Figure 6:
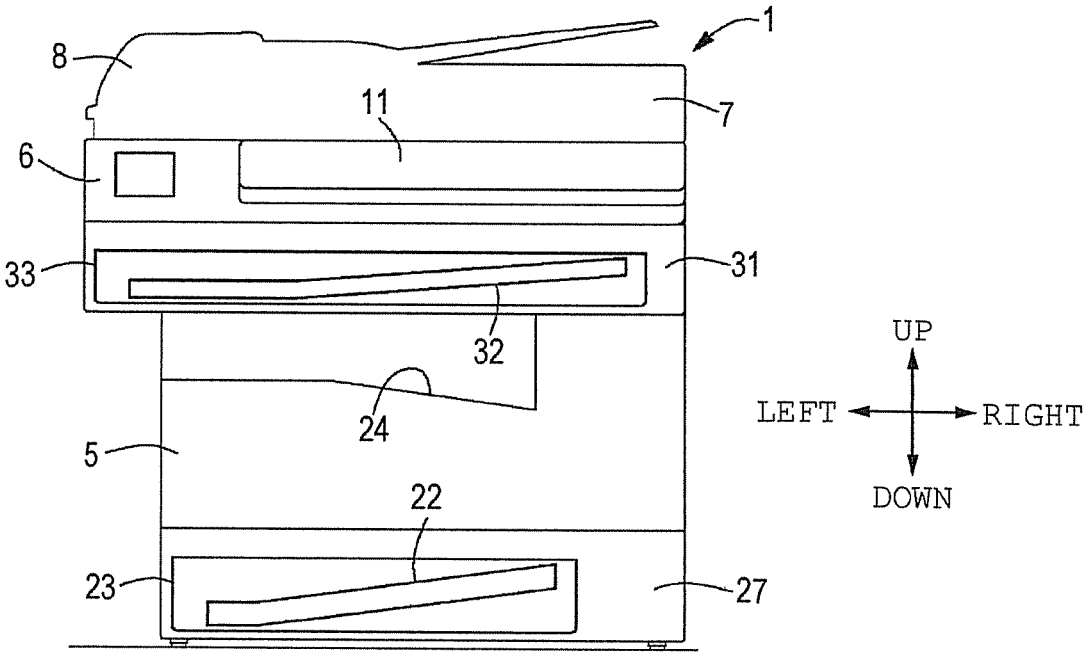
FIG. 6 is a schematic configuration view of an image forming device in accordance with a second embodiment of the present invention.
Figure 7:
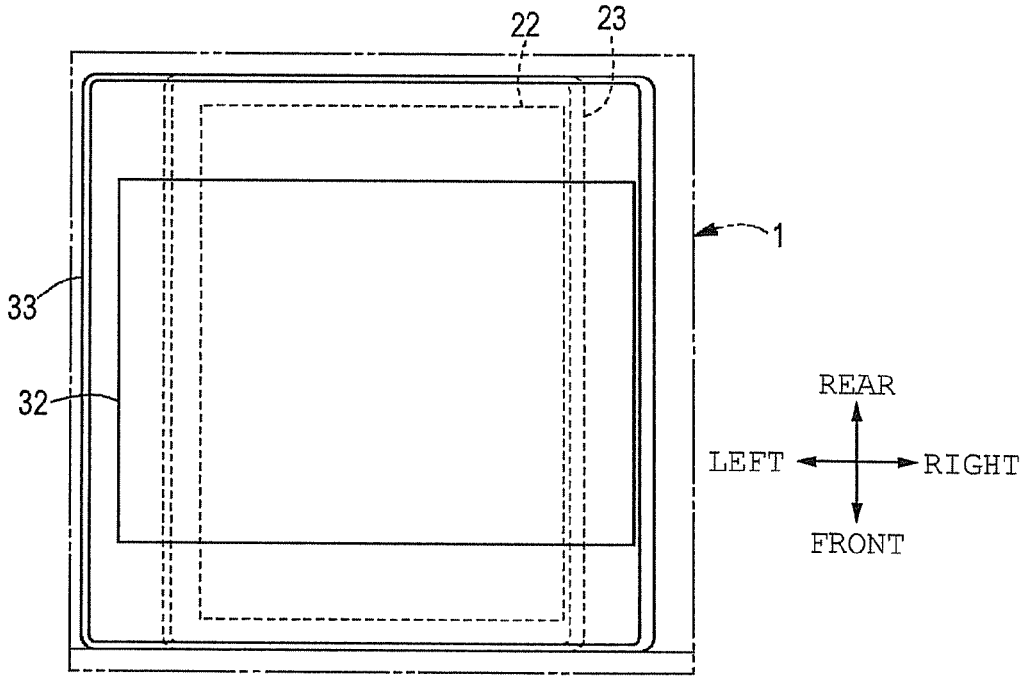
FIG. 7 is a schematic plan view for describing the image forming device in accordance with the second embodiment of the present invention.

FIG. 6 and FIG. 7 illustrate a second embodiment of an image forming device of the present invention. A multi-function peripheral 1 in accordance with the second embodiment is different from the image forming device in the first embodiment in that both the upper paper feed cassette 33 and the lower paper feed cassette can store the maximum size recording sheets 32 and 22, respectively, on which the image recording unit 4 can record an image. That is, the recording sheets 22 and 32 of the same size are stored in the paper feed cassettes 23 and 33, respectively.

As illustrated in FIG. 6, positions of the paper feed cassettes 33 and 23 in the body 5 are different from each other. Specifically, the upper paper feed cassette 33 is assembled in the body 5 such that its long-side direction is the lateral direction. The lower paper feed cassette 23 is assembled in the body 5 such that its long-side direction is the front and rear direction. In other words, the recording sheet 32 is stored in the upper paper feed cassette 33 such that the long-side direction of the maximum size recording sheet 32 is the lateral direction, and the recording sheet 22 is stored in the lower paper feed cassette 23 such that the short-side direction of the maximum size recording sheet 22 is the lateral direction.

With the multi-function peripheral 1 thus configured, since the width of the lower paper feed cassette 23 in the lateral direction can be reduced, the lateral width of the bottom of the multi-function peripheral 1, that is, the lateral width of the installed multi-function peripheral 1, can be smaller than the lateral width of the upper paper feed cassette 33 and the lateral width of the paper feed cassette storage unit 31 that stores the paper feed cassette 33. Therefore, the lateral width of the bottom area of the multi-function peripheral 1 can be reduced, achieving a small footprint.

Also in the second embodiment, the number of the upper paper feed cassette 33 and the number of the lower paper feed cassette 23 are not limited to one, and may be two or more.

While the present invention has been described with respect to embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention

What is claimed is:

1. An image forming device comprising:

an image recording unit for recording an image on a recording sheet;

an upper paper feed cassette storage unit arranged fixedly above the image recording unit;

a lower paper feed cassette storage unit arranged below the image recording unit;

an image reading unit arranged fixedly above the upper paper feed cassette storage unit;

a paper exit tray formed below the upper paper feed cassette storage unit;

a lower paper feed cassette stored in the lower paper feed cassette storage unit; and an upper paper feed cassette stored in the upper paper feed cassette storage unit, the upper paper feed cassette storage unit having a larger lateral length than that of the lower paper feed cassette storage unit.

2. The image forming device according to claim 1, further comprising:

a first transportation path provided between the lower paper feed cassette storage unit and the paper exit tray, the first transportation path transporting the recording sheet fed from the lower paper feed cassette to the paper exit tray via the image recording unit;

a second transportation path provided in parallel with the first transportation path, the second transportation path inverting the recording sheet transported via the image recording unit; and a third transportation path provided between the upper paper feed cassette storage unit and the second transportation path, the third transportation path transporting the recording sheet fed from the upper paper feed cassette to the second transportation path, wherein the recording sheet fed from the upper paper feed cassette is transported to the first transportation path through the third transportation path and the second transportation path.

3. The image forming device according to claim 1, wherein the upper paper feed cassette has a size capable of storing a maximum size recording sheet on which the image recording unit can record an image, and the lower paper feed cassette is a cassette that is smaller than the upper paper feed cassette.

4. The image forming device according to claim 3, further comprising:

a first transportation path provided between the lower paper feed cassette storage unit and the paper exit tray, the first transportation path transporting the recording sheet fed from the lower paper feed cassette to the paper exit tray via the image recording unit;

a second transportation path provided in parallel with the first transportation path, the second transportation path inverting the recording sheet transported via the image recording unit; and a third transportation path provided between the upper paper feed cassette storage unit and the second transportation path, the third transportation path transporting the recording sheet fed from the upper paper feed cassette to the second transportation path, wherein the recording sheet fed from the upper paper feed cassette is transported to the first transportation path through the third transportation path and the second transportation path.

5. The image forming device according to claim 1, wherein a maximum size of the recording sheet stored in the upper paper feed cassette is set to be equal to a maximum size of the recording sheet stored in the lower paper feed cassette, and the recording sheet is stored in the upper paper feed cassette such that a long-side direction of the maximum size recording sheet is a lateral direction, and the recording sheet is stored in the lower paper feed cassette such that a short-side direction of the maximum size recording sheet is the lateral direction.

6. The image forming device according to claim 5, further comprising:

a first transportation path provided between the lower paper feed cassette storage unit and the paper exit tray, the first transportation path transporting the recording sheet fed from the lower paper feed cassette to the paper exit tray via the image recording unit;

a second transportation path provided in parallel with the first transportation path, the second transportation path inverting the recording sheet transported via the image recording unit; and a third transportation path provided between the upper paper feed cassette storage unit and the second transportation path, the third transportation path transporting the recording sheet fed from the upper paper feed cassette to the second transportation path, wherein the recording sheet fed from the upper paper feed cassette is transported to the first transportation path through the third transportation path and the second transportation path.

* * * * *